United States Patent [19]

Scholl

[11] 4,408,396

[45] Oct. 11, 1983

[54] TRIM KNIFE

[76] Inventor: Albert S. Scholl, 2706 S. Kedvale, Chicago, Ill. 60623

[21] Appl. No.: 358,198

[22] Filed: Mar. 15, 1982

[51] Int. Cl.[3] ..... B26B 3/08

[52] U.S. Cl. ..... 30/294; 30/339

[58] Field of Search ..... 30/289, 293, 294, 317, 30/339, 338, 337, 320

[56] References Cited

U.S. PATENT DOCUMENTS

| | | | |
|---|---|---|---|
| 1,556,613 | 10/1925 | Ladeveze | 30/320 |
| 1,619,249 | 3/1927 | Duff | 30/338 |
| 1,651,667 | 12/1927 | Burke | 30/320 |
| 2,267,059 | 12/1941 | Voight | 30/339 X |
| 2,304,332 | 12/1942 | Bodkin | 30/335 |
| 2,432,345 | 12/1947 | Sloman | 30/339 |
| 2,853,778 | 9/1958 | Pratt | 30/294 |
| 2,870,537 | 1/1959 | Ortner | 30/320 X |
| 3,500,540 | 3/1970 | Lundquist | 30/294 |
| 3,845,554 | 11/1974 | Joanis | 30/339 X |

*Primary Examiner*—Jimmy C. Peters

*Attorney, Agent, or Firm*—McCaleb, Lucas & Brugman

[57] ABSTRACT

A hand operated tool for cutting and trimming materials, such as carpet, wallpaper and like covering materials. The tool is particularly useful in the hanging of wall coverings and is made up of a pair of mating half sections, which form an elongated handle and a blade-holding socket disposed in angular relation to the major axis of the handle with a finger engaging area designed to assist the user in applying cutting force to the blade. A quick, disconnect anchor device is provided whereby a single spring biased pin is movable transversely through the walls of the blade-holding socket and an opening formed in the blade itself for locking the blade in operating position between angulated wall-engaging guide means, extending substantially along opposite sides of the blade's cutting edge.

8 Claims, 10 Drawing Figures

Fig. 1.
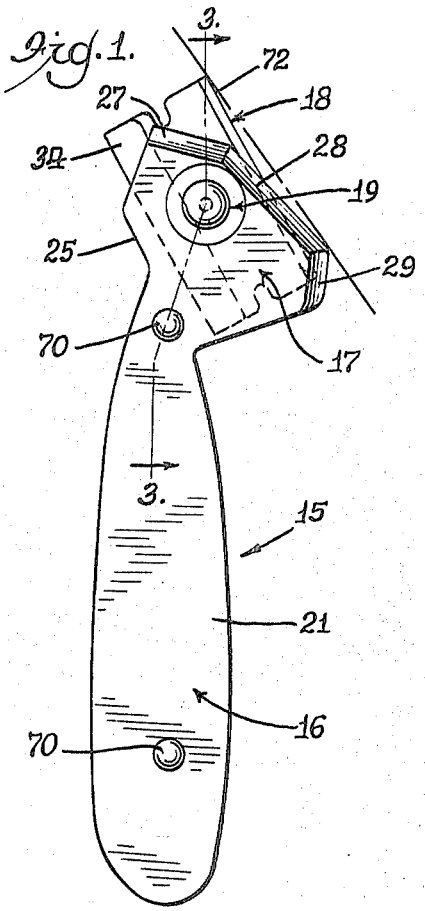
Fig. 2.
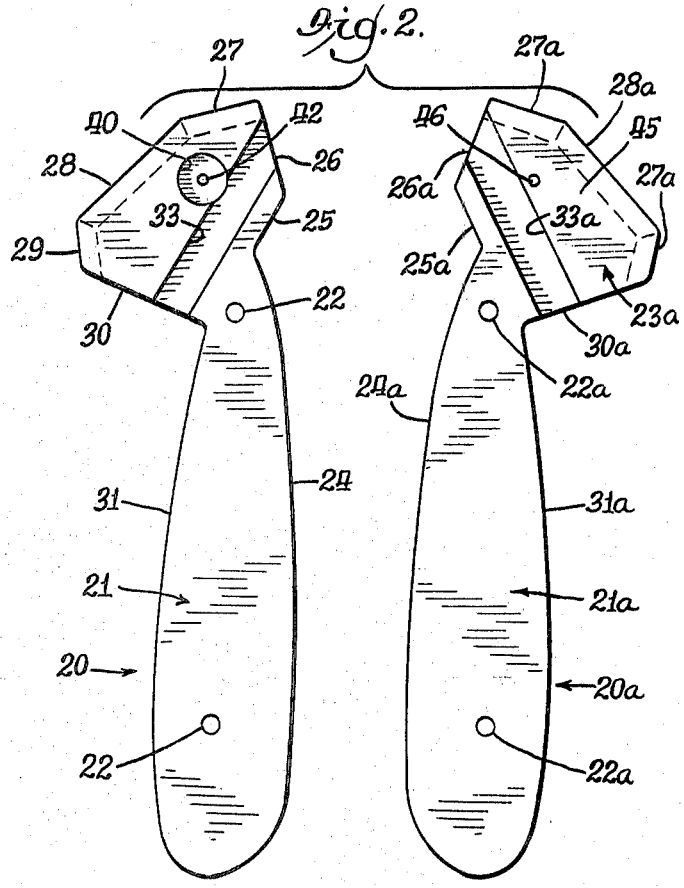
Fig. 3.
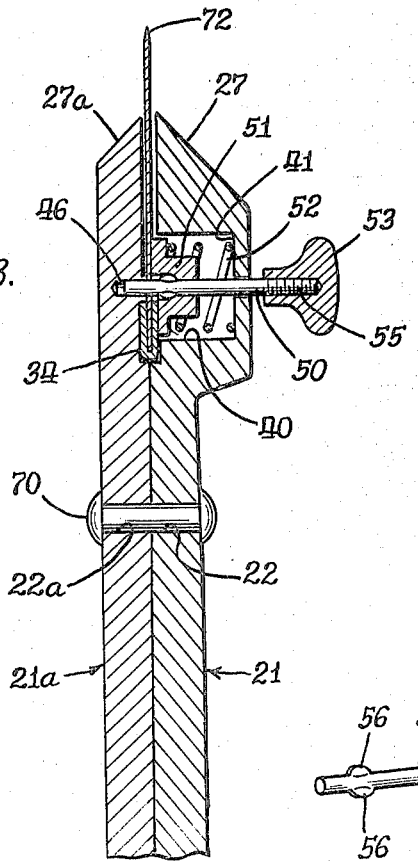
Fig. Д.
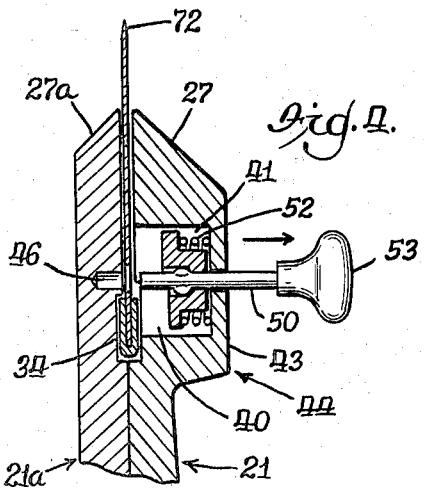
Fig. 5.
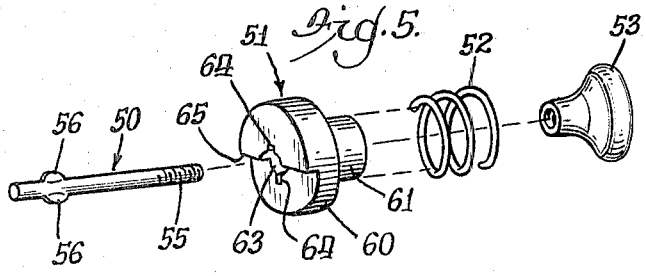

TRIM KNIFE

BACKGROUND OF THE INVENTION

Under current practice, wallpaper hangers and like workmen, when mounting covering materials over a wall, usually trim the top and bottom margins thereof by means of a straight edge and a razor blade, the straight edge acting as a guide for movement of the blade along a desired line of cut. Lateral edges of the covering material are similarly cut, particularly at corners of the room. In still other developments, so-called margin trimmers, which in general comprise razor blade holders of one type or another, have been developed for use with a straight edge guide as well as wheel knife trimmers which are rolled along a desired line of cut with or without the use of a guiding straight edge. In still other instances, modified wheel knives having serrated edges on the knife wheel have been developed to provide a series of perforations through the wall covering material, weakening the same along a desired tear line.

In all such prior known systems, great difficulty is encountered particularly in cutting the wall materials at corner intersections, for example, at the intersection of two sidewalls and a ceiling; such being greatly compounded by the need to employ a straight edge guide as above mentioned. This is especially true when using a razor blade per se since it is most difficult to hold the blade in a proper cutting position in a corner intersection while holding the straight edge guide in proper position. Even with the use of so-called utility knives in which the blade point extends forwardly of the blade handle, similar difficulty is encountered in attempting to cut a straight trim line.

In addition to the above-noted problem, currently known trim or utility knives, in which provision is made for holding a razor or other cutting blade, employ time consuming and cumbersome means for securing the blade in cutting position. In most instances, it is necessary to disassemble the knife housing to expose a mounting socket for the blade which is held in position by a system of interlocking projections on the housing. Once the blade is mounted in the socket, re-assembly of the housing is required.

BRIEF DESCRIPTION OF THE INVENTION

In recognition of the foregoing difficulties, the present invention is directed to improvements in trim knife structures.

In brief, this invention comprises an improved combined blade holder and handle structure comprising two half sections adopted to be matingly aligned to form an extending manually engageable handle portion and a blade holding socket portion, the latter being disposed in angular relation to the longitudinal axis of the handle portion and presenting means for assisting the user in applying cutting pressure to the blade, particularly in corner areas. A quick acting and simplified anchoring system is incorporated in the structure comprising spring loaded pin means adapted to pass through the blade holding socket and an opening in the blade body to anchor the blade in its holding socket. In addition, suitable guide means are provided adjacent the blade's cutting edge for purposes of engaging surfaces along a prescribed line of cut whereby to align and maintain the cutting edge of the blade at a desired attack position.

This feature eliminates the need for additional straight edge guide means and the like.

It is a principal object of this invention to provide a new and improved trim knife, particularly useful in trimming wall covering materials and the like.

A still further object of this invention is to provide an improved trim knife, as aforesaid, incorporating quick acting and simplified means for attaching and anchoring a cutting blade in a holder therefor.

Still another object of this invention is to provide an improved and simplified trim knife construction embodying integrated manually engageable handle and blade holding socket means and incorporating means for guiding the cutting edge of the blade along a prescribed line of cut at a preselected and predetermined angle of attack.

Having described this invention, the above and further objects, features and advantages thereof will be apparent to those familiar with the art from the following detailed description of a preferred embodiment thereof, illustrated in the accompanying drawings and representing the best mode presently contemplated for enabling those of skill in the art to make and practice this invention.

IN THE DRAWINGS

FIG. 1 is an elevational view of the assembled tool in accordance with this invention;

FIG. 2 is an elevational view of the two mating housing sections in separated condition and comprising the handle and blade holding portions of the tool when assembled as shown in FIG. 1;

FIG. 3 is an enlarged partial cross-sectional view taken substantially along vantage line 3—3 of FIG. 1 and looking in the direction of the arrows thereon;

FIG. 4 is another enlarged partial sectional view corresponding to the upper portion of FIG. 3, but illustrating the blade holding means in a blade releasing position;

FIG. 5 is an exploded perspective view illustrating the parts of the blade holding means;

DESCRIPTION OF THE PREFERRED EMBODIMENT

Figure 6:
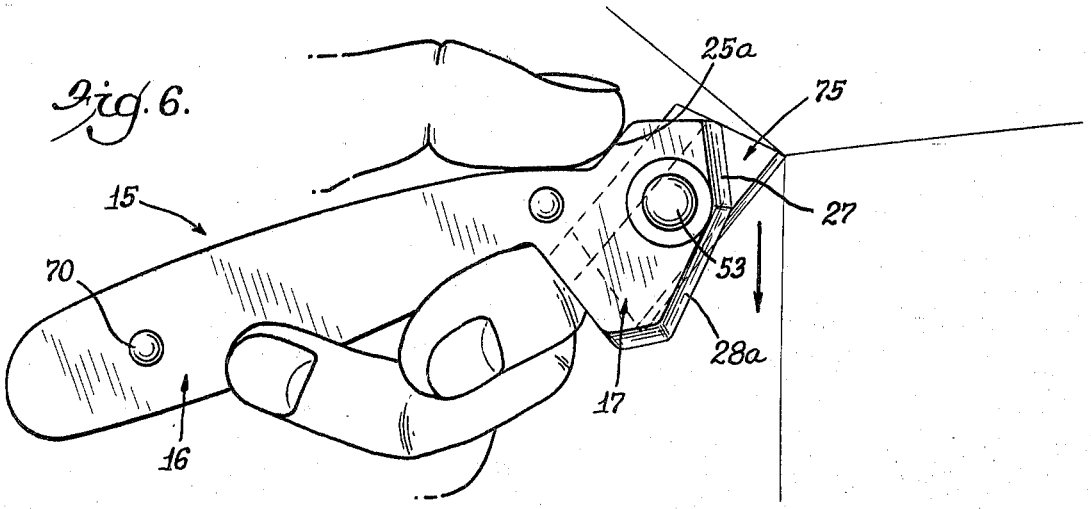
FIG. 6 is a perspective view of the trim knife hereof in position for initiating a trim cut at the corner intersection of two walls on a ceiling.

Turning now to the features of the preferred embodiment illustrated in the accompanying drawings, particular reference is made to FIG. 1 wherein a trim knife assembly 15, in accordance with this invention, is shown as comprising an elongated handle portion 16 having an integral blade holding portion 17 disposed transversely across one outer end thereof for holding a blade means 18 in cooperation with quick release locking means 19.

With particular regard to the handle and blade holding portions 16 and 17, reference is made to FIG. 2 of the drawings whereat are illustrated right and left hand half sections 20, **20*a* which are generally mirror reflections of one another in form and are adapted to matingly interface along their inside planar faces to formulate the rounded handle portion 16 and blade holder portion 17** previously alluded to.

Specifically, with regard to the right hand section 20, it will be noted that the same is preferably formed with an elongated oval-shaped half handle portion 21 having two openings 22, 22 therethrough disposed near the outer end of the handle portion 21 and the integrally joined half section of the blade holder portion 17 indicated by numeral 23. The handle portion is formed with a curvilinear exterior formation to fit into the palm of the user's hand when assembled and may, if desired, bear exterior gripping means as provided by a rough, grooved, pebbled or other nonslip exterior formed during its manufacture, as by molding or casting metal or plastic. It will be noted that the outside or operationally upper curved edge 24 of handle portion 21 merges into a straight edge 25 of the blade holding portion 17 which is disposed in obtuse angular relationship (approximately one-hundred and twenty degrees) with respect to the longitudinal axis of the handle portion 21. This relationship between the curvilinear upper edge 24 and the straight edge portion 25 just described is such that when grasping the handle during operation, the user's thumb or index finger may comfortably engage edge 25 for the purpose of applying pressure to the cutting edge of the blade means 18 during cutting operation, as will appear in greater detail hereinafter (see FIGS. 6 and 7).

As shown in FIG. 2 the blade holding portion 23 of the half section 21 comprises a six sided end profile including the described edge portion 25, intersecting edge portions 26 and 27, generally disposed at right angles to one another, with edge portion 25 and 26 intersecting at substantially forty-five degrees to formulate the outer or nose end of the knife blade holder. Edge portion 27 in turn intersects an elongated edge portion 28 which borders the blade means 18 in assembly, with the angle of intersection between edges 27 and 28 being substantially forty-five degrees. Edge portion 28 also intersects a shorter end edge portion 29, again, at substantially forty-five degrees; edge portion 29 comprising the heal of the blade holder portion 23. Edge 29 also extends angularly between and at substantially forty-five degrees with respect to, the edge portion 28, as previously noted, and joins a rear edge portion 30 extending between edge portion 29 and the bottom curvilinear edge 31 of the handle section 21.

As best shown in FIGS. 1–4, edge portion 27 is beveled toward the outside surface of the holder portion 23 at substantially a forty-five degree angle. The same is true as to the edge portions 28 and 29 which are also useful as wall engaging guide means for disposing the cutting blade 18 at an appropriate angle with respect with the materials to be attacked thereby. All this will be amplified in greater detail under the operational description of the trim knife of this invention hereinafter.

As best shown in FIG. 2, the blade holding portion 23 is provided with a normally rectangular shape recessed area 33 extending across portion 23 between the edges 30 and 26 and substantially paralleling edge 25 thereof. This recessed area is for the purpose of receiving and providing clearance for the thickened back 34 of a single edge razor blade of the order shown at 18 in FIGS. 3 and 4. When a cutting blade is employed which does not have such heavy back edge 34, then the recessed area 33 is no longer required. Blade holder portion 23 further is provided with a recessed socket 40 shown herein as cylindrical in formation and having a closed bottom wall 41 (see FIGS. 3 and 4) receptive of the blade holding means 19 as will be described presently. The bottom wall 41 of the socket 40 is provided with a through opening 42 passing through the back or outer side of portion 23 and more specifically through a wall 43 of an outwardly projecting boss 44 formed integrally over and about the socket 40 on the outer face of the holder portion 23.

Having described the right hand combined handle and blade holder section 21, it will be appreciated from FIG. 2 that the corresponding left hand section **21*a* constitutes a reverse image or counterpart thereof and therefore will not be described in further detail herein except for certain differences over the described section 21. It further will be noted that in FIG. 2 of the drawings the corresponding parts of the left hand section 21*a* are numbered in accordance with the described section 21** with the suffix "a" added thereto.

Turning to the differences of member **21*a* from the described section 21, it should be noted that substantially the entire inside surface 45 of its blade holder portion 23*a* is cut away or recessed slightly to accommodate the thickness of the cutting blade 18. Correspondingly, the blade back recess 33*a* thereof is slightly deeper than the corresponding recess 33 of the right hand blade holding portion 23 described above. In addition, the outside face of the blade holding section 23*a* is formed without a boss portion corresponding to the boss portion 44 associated with the locking means 19. Further, the recessed surface 45 is provided with a blind bore opening 46 coaxially aligned with the through opening 42 in the right hand section 21 for cooperation with the blade holding means 19** as will appear forth presently.

As best illustrated in FIGS. 3, 4 and 5 of the drawings, the blade holding means 19 comprises a pin or stake 50, a retainer or guide block 51, spring means 52 and an operating knob 53. The pin or stake is preferably cylindrical in formation and of a diameter just slightly smaller than the diameter of the openings 42 and 46 in the respective half sections 21 and **21*a* described hereinabove. One outer end of pin 50 is suitably threaded as at 55 for the mounting connection of the operating knob 53 thereto, as will appear presently. Adjacent the opposite or inner end of the stake member or pin 50 are a pair of oppositely directed upset ears 56, 56 for locking the pin member 50 against rotation relative to the block 51**, to be described hereinafter.

The guide block 51 illustrated comprises a generally cylindrical body portion 60 having a cylindrical boss 61 formed integrally therewith and projecting axially outwardly of one side thereof and of a diameter to fit within the internal coil diameter of the spring means 52 in assembly. The body and boss portions 60 and 61 are centrally bored with a cylindrical opening 63 of a diameter just slightly bigger than the outside diameter of the stake or pin 50 whereby the latter is insertable through the block 51 with the stake portions 56, 56 thereof engaging diametrically opposed slotted openings 64, 64 formed at one outer end of the central opening 63. In assembly the stake portions 56, 56 enter the slotted openings 64, 64, interlocking the pin 50 and retainer block against relative rotation. In addition, the one outer end of the block 51 in which the slotted openings 64, 64 are formed, is offset to provide a substantially diametrical shoulder 65 across one end thereof.

As previously noted, the spring means 52 is adapted to fit over the cylindrical boss portion 61 of the retainer block 51 in assembly so that one end of the spring means 52 abuts the enlarged cylindrical body portion 60 of the block 51 while the opposite end of the spring means 52 bears against the bottom wall 41 of the socket 40 formed in the right hand half section 21.

With particular reference to FIGS. 3 and 4, it will be recognized that the locking or holding assembly 19 illustrated in FIG. 5, is mounted within the socket 40 with the stake or pin means 50 thereof extending outwardly through the bottom wall 43 of the boss portion 44. Thereafter the operating knob member 53 is threaded onto the outer end of the stake member 50, locking the knob on one side of the wall 43 and locking the block 51 and spring means 52 within socket 40 on the opposite side of the wall member 43. In this manner the block 51 is adapted to move coaxially with the pin means within the socket 40, to move the inner end of the pin 50 into and out of the opening 46 formed in the left hand section 21*a*. This action is used to retain the cutting blade means 18 within the holder portion 17 of the tool means. It also contemplated that socket 40 and block 51 may have interfitting surfaces to prevent rotation of the block 51 in the socket.

Figure 8:
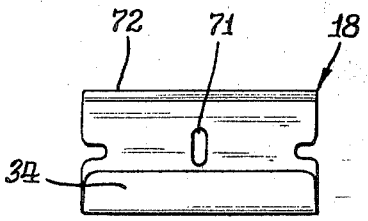
FIGS. 8 and 9 are elevational views and FIG. 10 is a perspective view of alternate cutting blades useful in the holder of this invention.

It will be appreciated and understood from FIGS. 1, 3 and 4 that the two half sections 21 and 21*a* are adapted to be mounted with their inside faces in abutting face-to-face relationship, the same preferably being held in such relationship by means of a pair of rivets 70, 70 extending through the openings 22 and 22*a* of the two handle portions. It is contemplated that handle portions 21, 21*a* may be made of molded plastic or the like, in which event the same may be mated in face-to-face relationship and welded together by suitable adhesive, plastic melt or the like. In any event, when the two half sections 21, 21*a* are so unified, as illustrated in FIGS. 1, 3 and 4, they form an open-ended blade receptive socket therebetween comprising the clearance spacing provided by the cut-away face 45 of the left hand holder section 21*a* and the recesses 33 and 33*a* designed to receive the thickened back 34 of a single edge razor blade 18 or the like. Mounting of the blade in between the two half sections is accomplished by simply sliding the same endwise into the holder socket thus provided to position the same in the manner illustration in FIG. 1. During this operation, the pin 50 of the blade holding means 19 is retracted to permit passage of the blade until an opening 71 formed generally centrally of the blade (see FIG. 8) is located opposite the pin member 50. Once the blade is so aligned, the pin 50 is released to the forces of the spring member 52 which causes the block 51 to move with the pin 50 against the blade 18. Eventually the outer end of the pin enters the blind bore socket 46 as previously noted and the shouldered outer end of the block's body portion 60 abuts against the blade means 18 with the transverse shoulder 65 thereof underengaging the lower edge of the blade's thickened back portion 34, as shown in FIG. 3. In this fashion the blade is securely held against movement in and out of the blade holding socket for operation of the tool. Conversely, quick removal of the blade is permitted by retracting the pin 50 and withdrawing the blade from the blade holding socket.

As shown in FIG. 1, when blade means 18 is properly positioned in the holding socket and the locking means 19 is engaged with the blade, only one end or corner portion of the blade's cutting edge 72 is exposed for use. Such cutting edge portion is aligned in intersecting angular relation with respect to the beveled guide edges 27, 27*a* and 28, 28*a* of the holder, with such extension of the exposed portion of the cutting edge of the blade therepast providing a fixed normal penetration of materials to be attacked thereby, such as wallpaper, carpeting, etc.

Figure 9:
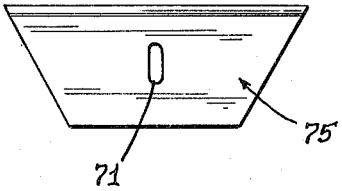
Figure 10:
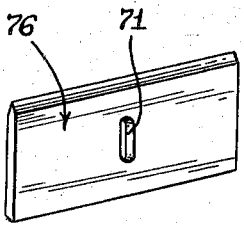

While the above referred to single edge razor blade 18 is preferred for most operating circumstances, alternate blades such as the trapezoidal shaped utility knife blade 75 of FIG. 9 or the rectangular shaped blade 76 of FIG. 10 may be used in the tool 15, as desired. In using any of these blades, the same are reversible, i.e. both corner portions of the cutting edges therein may be exposed for cutting operation in the tool 15 as indicated in FIG. 1.

USE AND OPERATION

Figure 7:
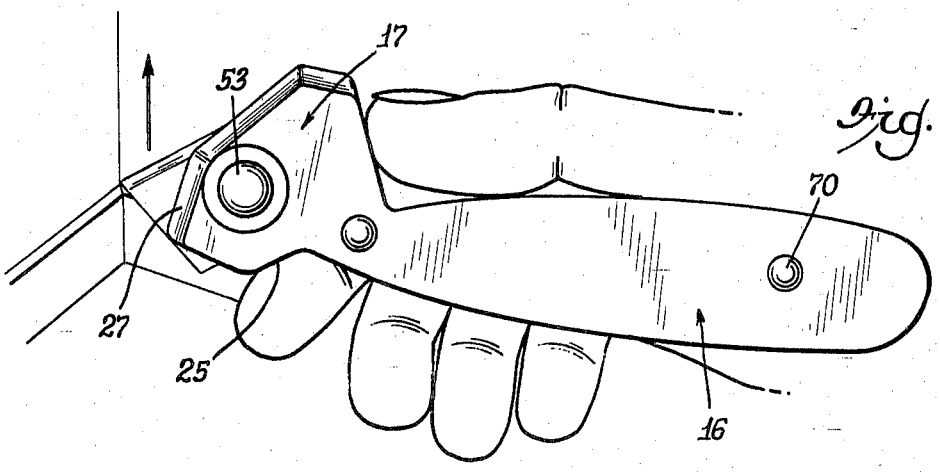
FIG. 7 is another perspective view similar to FIG. 6, but showing the knife in position for starting a trim cut at the baseboard and corner intersection of two walls.

Having described the various elemental portions of the improved trim knife tool according to this invention, its operational features will now be set forth with particular reference to FIGS. 6 and 7 of the drawings.

As shown in FIG. 6 when it is desired to trim material, such as wall covering, at the intersection of a ceiling and two side walls, the tool 15, preferably is held in the right or left hand as desired, with the thumb of the operator engaging the edges 25, 25*a* and the handle grasped in the operator's palm. The outer exposed tip or end of the cutting blade, such as the angle-ended knife blade 75 illustrated in FIG. 9, or either of the blades 18 or 76, as desired, is positioned at the intersection of the ceiling and the two walls. Pushing of the thumb against the edges 25, 25*a* is then used to apply pressure to the blade causing the same to penetrate the covering material at the intersection of the three walls. The trim knife is then swung downwardly until the guide surfaces 28, 28*a* engage the two side walls, the surfaces 28, 28*a* being at right angles to one another. Next the knife is drawn downwardly along the desired line of cut, i.e. at the corner intersection of the two sidewalls. In this fashion, the guide surfaces 28, 28*a* engaged with the side walls maintain the blade in a desired and steady position throughout the cutting cycle while thumb pressure maintains the proper penetration and cutting force on the covering material as the blade is drawn downwardly.

In FIG. 7 an alternate operating position for the tool 15 is demonstrated wherein the tool is reversed so as to perform an upward cutting movement from the bottom corner intersection of two side walls and baseboard. As illustrated, again the outer exposed end of the knife blade's cutting edge is inserted through the wall covering material at the beginning end of the cut, after which the knife is swung upwardly until the two guide edges 28, 28*a* engage the side walls to steady the knife during its upward movement along a desired line of cut. In this operation, the operator's index finger normally engages the tool edges 25, 25*a* to apply cutting pressure.

It will be recognized in each instance that no external guide means is required to maintain the trim knife and particularly the knife blade thereof in a proper attack position while the same is drawn along a straight trim line. Desired cutting pressure is maintained by pressure of the operator's index finger or thumb on the surface edges 25, 25*a* of the holder portion 17. When it is desired to trim along the ceiling or baseboard line, a similar program is followed, namely, penetration of the material by the outer end of the knife blade followed by engagement of the holder's inbuilt guide means with the wall, baseboard and ceiling surfaces, as the case may be, to maintain the flight path of the knife blade along a straight line.

In those instances where it is desired to cut materials of heavier weight or thickness, such as carpeting, the trim knife operation is similar to that described above except that after penetration of a deep pile material, for example, guide edges 27, 27*a* are used to maintain the knife blade along a desired line of cut. Again, the cutting pressure is effected by the user's thumb or index finger on edges 25, 25*a*.

From the foregoing, it is believed that those familiar with the art will readily recognize the advanced merits of the present invention and appreciate that while the same has been described hereinabove in association with a preferred embodiment illustrated in the accompanying drawings, the described tool is susceptible to variations, modifications, and substitutions of equivalents without departing from the spirit and scope of the invention which is intended to be unlimited by the foregoing except as may appear in the following appended claims.

The embodiments of the invention in which an exclusive property or privilege is claimed are defined as follows:

1. A hand tool for trimming wall covering materials, carpet and the like, comprising: a combined manually-engageable handle and integral blade holder, said blade holder being disposed transversely across one end of said handle and comprising an internal, open-ended blade holding socket aligned in angular intersecting relation to the lengthwise axis of the handle; and locking means for holding a cutting blade in said socket in position to engage materials to be trimmed comprising spring loaded pin means movable transversely through and between opposing walls of said socket and an opening in an intervening cutting blade mounted therein.

2. The tool of claim 1, wherein said blade holder comprises a pair of right angularly related guide edge portions extending partially along the length of and on opposite sides of the cutting edge of said blade and aligned intersectingly with said cutting edge so that only a portion thereof is exposed beyond said edge portions; said guide edge portions serving to engage adjacent wall surfaces in operation.

3. The tool of claim 1, wherein said locking means comprises a block member affixed to one end of said pin means interiorly of said holder, spring means engaging said block member and one interior wall of said holder, and manually engageable means, disposed exteriorly of said one wall and fastened to the outer other end of said pin means whereby pulling on said manually engageable means serves to compress said spring means and withdraw said pin means from said socket for quick release of said blade therefrom.

4. The tool of claim 1, wherein said combined handle and holder comprises two half sections each with a unified handle portion and holder portion, said sections have opposing surfaces which when disposed in face-to-face relation make up a unified handle and holder, and means securing said sections together as a unitary structure.

5. The combination of claim 4, wherein the holder portion of each said section is formed with a generally rectangularly elongated recess extending lengthwise of said holder portion and formed inwardly of the opposing surface of its related said section, and one of said sections having the opposing said surface of the holder portion thereof recessed whereby when said sections are secured together, said rectangular recesses and said recessed surface form an open-ended socket receptive of a single edge cutting blade having a reinforced backing along one edge.

6. The tool of claim 1, wherein said holder has an edge portion disposed in obtuse angular relation to the lengthwise axis of the said handle and presenting manually engageable surface means to the thumb or finger of the user whereby cutting pressure may be applied to a blade mounted in said socket.

7. The tool of claim 2, wherein said holder and socket therein are formed for endwise insertion of a cutting blade into said socket, and said locking means is operable to anchor said blade in said socket with a portion of said blade projecting forwardly beyond said holder.

8. The combination of claim 7 and guide surface means at the end of said holder adjacent the projecting portion of said blade, said guide surface means comprising beveled edge surfaces of said holder disposed on opposite sides of a blade mounted in said socket and extending transversely across a portion of said blade.

* * * * *